US008079394B2

(12) United States Patent
Bella

(10) Patent No.: US 8,079,394 B2
(45) Date of Patent: Dec. 20, 2011

(54) BELT FOR A CORRUGATOR MACHINE HAVING A FRICTION COEFFICIENT REDUCED DRIVEN SIDE

(75) Inventor: Hartmut Bella, Elchingen (DE)

(73) Assignee: Muehlen Sohn GmbH & Co., Blaustein (DE)

( * ) Notice: Subject to any disclaimer, the term of this patent is extended or adjusted under 35 U.S.C. 154(b) by 500 days.

(21) Appl. No.: 12/289,488

(22) Filed: Oct. 29, 2008

(65) Prior Publication Data

US 2009/0107637 A1 Apr. 30, 2009

(30) Foreign Application Priority Data

Oct. 30, 2007 (EP) ..... 07021154

(51) Int. Cl.
*B31F 1/20* (2006.01)
*D21F 7/10* (2006.01)

(52) U.S. Cl. ..... 156/462; 162/902; 442/97; 442/209

(58) Field of Classification Search ..... 162/348, 162/358.2, 900, 902–904, 296; 139/383 AA, 139/383 A, 425 A; 34/95; 156/462; 198/846, 198/847; 442/97, 101, 209, 217, 218
See application file for complete search history.

(56) References Cited

U.S. PATENT DOCUMENTS

| | | | | |
|---|---|---|---|---|
| 5,785,621 | A | 7/1998 | Birzele | |
| 2008/0135199 | A1 * | 6/2008 | Rouhling | 162/296 |

FOREIGN PATENT DOCUMENTS

| | | |
|---|---|---|
| DE | 197 46 848 | 4/1999 |
| EP | 0 950 508 | 10/1999 |
| WO | WO 02/086231 | 10/2002 |
| WO | WO 02086231 | * 10/2002 |
| WO | WO 02086232 | * 10/2002 |

* cited by examiner

*Primary Examiner* — Eric Hug
(74) *Attorney, Agent, or Firm* — Walter Ottesen

(57) ABSTRACT

The invention relates to a belt for a corrugator machine for making corrugated board (50) wherein at least a middle layer (52) of corrugated material is joined under pressure to cover layers (51, 53) of smooth material to form the corrugated board (50). The belt (1) is made of a fabric of warp fibers and weft fibers (4) and has a paper side facing toward the corrugated board (50) to be manufactured. The paper side (6) lies against the corrugated board (50). A driven side (7) lies facing away from the corrugated board (50). The corrugator machine has a pressure zone (70) which includes a pressure element (71) and a countersupport (73). The corrugated board (50) together with the contact engaging fabric belt (1) passes between the pressure element (71) and the countersupport (73). A drive (61) is provided on the driven side (7) of the belt to generate the tension forces acting in the longitudinal direction of the belt. To reduce the friction loss in the pressure zone, a material is provided on the driven side (7) of the fabric belt (1) for reducing the coefficient of friction of the belt side defining the driven side (7).

20 Claims, 3 Drawing Sheets

BELT FOR A CORRUGATOR MACHINE HAVING A FRICTION COEFFICIENT REDUCED DRIVEN SIDE

CROSS REFERENCE TO RELATED APPLICATION

This application claims priority of European patent application no. 07021154.5, filed Oct. 30, 2007, the entire content of which is incorporated herein by reference.

FIELD OF THE INVENTION

The invention relates to a belt for a corrugator machine for manufacturing corrugated board.

BACKGROUND OF THE INVENTION

A belt of the kind referred to above is known from U.S. Pat. No. 5,785,621 and comprises a fabric of warp fibers and weft fibers. The belt has an outer paper side which faces toward the corrugated board to be manufactured. The paper side lies against the corrugated board and the belt has a driven side lying so as to face away from the corrugated board. Tension forces are introduced into the fabric belt via the driven side thereof.

In known corrugator machines, the corrugated board lies between two fabric belts and is pulled through a heating and pressure zone whereat the bonding of the individual layers of the corrugated board takes place. On the one hand, an adequate heating power is to be supplied in order to ensure the necessary temperature for liquefying the adhesive between the layers and, on the other hand, an adequate pressure is to be supplied which ensures a distribution of the adhesive between the layers and the reliable fixation of the layers to each other.

In order to provide a corrugator machine having a high manufacturing capacity, the following are needed: an adequate heating power must be available in the heating and pressure zone; an adequate pressure must be applied to the corrugated board; and, the transport speed through the heating and pressure zone must be correspondingly adapted. If the transport speed is increased, the heating power and the pressing power must be increased so that an adequate adhesion is ensured. The friction loss, however, increases between the fabric belt, which runs with the corrugated board through the heating and pressure zone, and the press shoes of the individual pressure elements. This increased friction power must be compensated by an increased drive power of the corrugator machine.

An increase in power of a corrugator machine can only be achieved via a higher drive power in order to balance out the increased pressure, which is needed to increase manufacture, and the accompanying friction loss between the fabric belt and the pressure shoe.

SUMMARY OF THE INVENTION

It is an object of the invention to increase the manufacturing capacity of a corrugator machine without increasing the drive power.

The belt of the invention is for a corrugator machine for manufacturing corrugated board having a middle layer made of corrugated material and a covering outer layer made of smooth material which are bonded together under pressure with adhesive, the belt defining a longitudinal direction and having a driven side, and the corrugator machine defining a transport direction and including a pressure element and a countersupport conjointly defining a pressure zone of the corrugator machine, the corrugated board and the belt lying thereon in the longitudinal direction and the belt with the corrugated board passing between the pressure element and the countersupport in the transport direction and the corrugator machine further including a drive unit arranged on the driven side of the belt for developing tension forces acting in the longitudinal direction. The belt includes: a fabric of warp fibers and weft fibers; the fabric defining a paper side of the belt facing away from the driven side and facing toward the corrugated board to be manufactured; the fabric defining the driven side of the belt with the driven side facing away from the paper side and having a coefficient of friction; and, a material disposed on the driven side for reducing the coefficient of friction of the driven side.

The driven side of the fabric belt, which runs through the heat and pressure zone, is provided with a friction coefficient reducing material and leads to a significant reduction of the friction work between the pressure shoes and the fabric belt passing through. An increased degree of sliding between the pressure shoes of the pressure elements and the fabric belt significantly reduces the needed drive power so that the reduced frictional force between the drive and the belt is without significance. Insofar as necessary, the reduced frictional force can be at least partially balanced out by increasing the wrap angle of the drive drum of the fabric belt.

The arrangement of the friction coefficient reducing material on the driven side of the fabric belt, which passes through the heating and pressure zone, leads to a power increase because for the same drive power, the pressure in the heating and pressure zone is increased and the transport speed of the corrugated board is increased.

The invention contradicts the efforts of the persons working in the field of the invention according to which the driven side, which faces toward the drive drum, is to be treated so as to increase the coefficient of friction to achieve a high drive power in the fabric belt.

The friction coefficient reducing material, which is applied to the driven side in accordance with the invention, is preferably applied as a coating over the entire surface on the driven side of the belt.

It can be adequate to apply the material to at least some of the fibers of the driven side which are processed as warp fibers on the driven side. The material can be applied as a coating to some of the fibers or individual fibers or all of the fibers of the driven side, preferably all warp fibers are of the friction coefficient reducing material.

It can be practical to form at least some of the fibers of the driven side, preferably the warp fibers, of twisted fibers. A portion of the twisted fibers comprises unchanged fiber material such as polyester and another portion of the twisted fibers comprises a material having a lesser friction coefficient, such as polytetrafluoroethylene.

The configuration of the fabric belt on the driven side can be so provided that, essentially, all warp fibers of a region, which lies between the longitudinal edges of the fabric belt, have the friction coefficient reducing material. The friction coefficient reducing material has a lower coefficient of friction than the material of the other fabric fibers which are processed on the same side.

Preferably, the material is a material acting as a lubricant during operation so that a distribution takes place over essentially the entire driven side of the fabric belt during operation. This is so even if only individual regions are treated with the friction coefficient reducing material or only individual warp fibers have the friction reducing material.

The material is a slide-friendly plastic such as a fully fluorinated polymer, preferably, polytetrafluoroethylene (TEFLON).

According to a feature of the invention, a belt for a corrugator machine is provided which comprises a fabric of warp fibers and weft fibers. The belt has a paper side facing toward the corrugated board to be manufactured and a driven side facing away from the corrugated board. The paper side of the fabric belt lies against the corrugated board whereas a drive acts on the driven side of the fabric belt which drive introduces tension forces into the belt which are necessary for the longitudinal movement of the fabric belt. The arrangement of a material for reducing the coefficient of friction on the belt side, which defines the driven side, leads to reduced friction work between the pressure elements and the driven side of the fabric belt in the heating and pressure zone. The friction coefficient reducing material has a lower coefficient of friction than the material forming the fabric belt.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
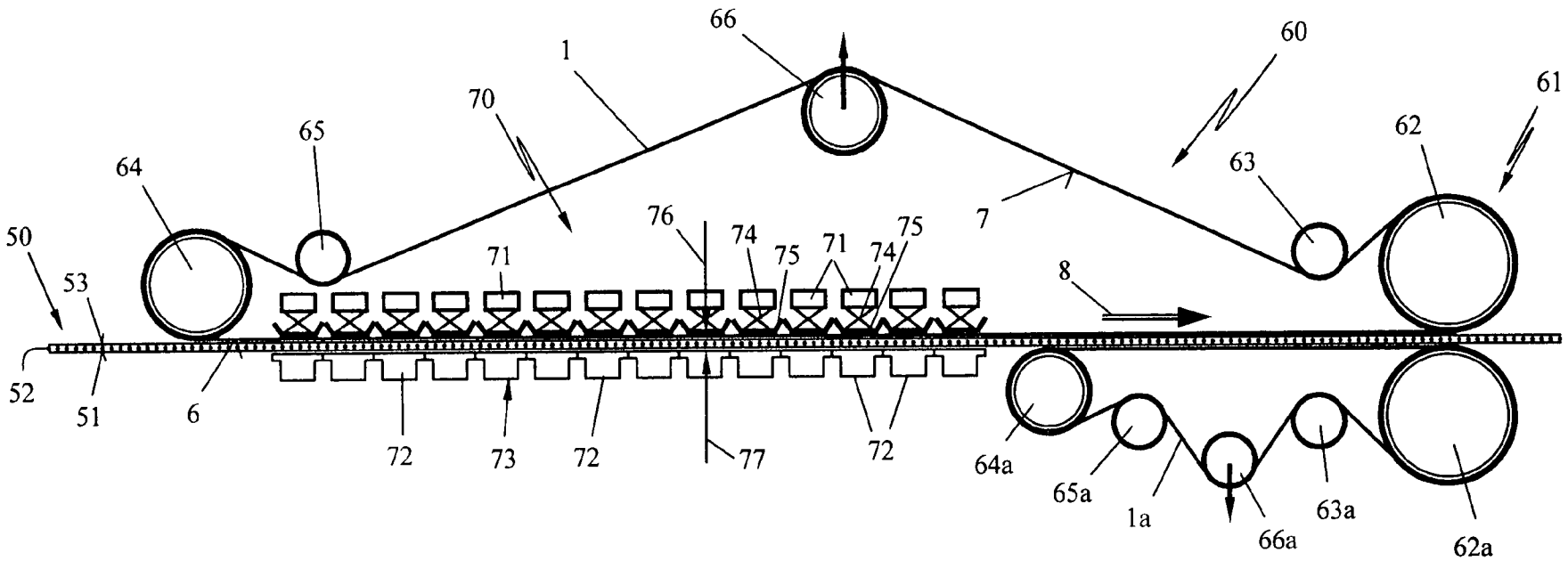
FIG. 1 is a schematic showing a corrugator machine for manufacturing corrugated board.

The corrugator machine 60 shown schematically in FIG. 1 functions to manufacture corrugated board 50. The corrugated board 50 comprises a middle layer 52 of corrugated material and covering outer layers 51 and 53 of smooth material. The middle layer 52 is bonded to the outer layers 51 and 53 under pressure and heat and are preferably bonded to each other with adhesive.

For this purpose, a pressure zone 70 is formed in the corrugator machine which comprises individual pressure elements 71 and corresponding countersupports 73. In the embodiment shown, fourteen pressure elements and fourteen countersupports 73 lie one behind the other in the transport direction 8. Each pressure element 71 has a press shoe 75 corresponding thereto. The press shoe 75 is pressed via a correspondingly configured spring element 74 with adjustable force tightly against the countersupport 73. Heaters 72 are formed in the countersupports 73. Preferably, a hot-air heater is provided. Electrical heating units could likewise be advantageous.

The corrugated board 50 to be manufactured is moved by the belt (1, 1*a*) through the heating and pressure zone 70. At the end of the heating and pressure zone 70, the corrugated board is grasped between the two belts (1, 1*a*) so that a tension force, which acts in the transport direction 8, is applied to both sides of the corrugated board 50.

The upper belt 1 is longer than the lower belt 1*a* because the upper belt 1 passes through the heating and pressure zone 70 together with the corrugated board 50. For this purpose, a drive 61 is provided which comprises an upper drive drum 62 for the upper belt and a lower drive drum 62*a* for the lower belt. A guide drum (63, 63*a*) is assigned to corresponding ones of the drive drums (62, 62*a*). With the aid of the guide drums (63, 63*a*), the wrap angle of the belt (1, 1*a*) is increased to more than 180° up to 300°. In this way, a higher torque can be transmitted to the belt.

Each belt (1, 1*a*) is guided over a deflection drum (64, 64*a*) which is assigned a guide drum (65, 65*a*). The necessary tension in the upper belt 1, as in the lower belt 1*a*, is ensured by a corresponding tension drum (66, 66*a*).

In the embodiment shown, the heating and pressure zone 70 lies within the continuous upper belt 1, that is, on the inner-lying driven side 7 of the belt 1. The outer side of the belt 1 is the paper side 6 which faces toward the corrugated board 50 and which lies on the corrugated board 50. In the embodiment shown, the paper side 6 lies on the outer side 53 of smooth material.

In order to obtain a good bond of the outer layers 51 and 53 of smooth material with the middle layer 52 of corrugated material, a force 76 acts via the press shoe 75 on the driven side 7 of the belt 1 with this force being opposed by the reaction force 77 from the countersupport 73. The outer layers 51 and 53 of the corrugated board 50 are pressed tightly against the middle layer 52 and are tightly bonded to each other with a previously applied adhesive under the action of the pressure and heat.

An adequate temperature as well an adequate operating time are needed to ensure a good adhesion of the corrugated board. The operating time is determined by the conveying speed in the transport direction 8. For a rapidly running machine with a high conveying capacity, a high temperature and a high pressure are needed which requires a high drive capacity of the drive 61 because of the friction power in the pressure and heating zone 70. If the pressure of the pressure elements 71 is reduced, then the needed drive power is reduced, however, then the heating power must be increased under certain circumstances in order to ensure a proper adhesion of the corrugated board 50 at the same transport speed.

To be able to increase the pressure of the individual pressure elements 71 without the drive power of the drive 61 increasing, a material is provided on the driven side 7 of the upper belt 1 which reduces the coefficient of friction of the driven side 7, that is, the coefficient of sliding friction between the press shoe 75 and the driven side 7 of the belt 1 is increased. With the friction coefficient reducing material on the driven side 7, the pressure can be increased without the drive power increasing. Accordingly, the heating power can be reduced or the conveying speed can be increased without the quality of the manufactured corrugated board 50 being reduced.

Figure 2:
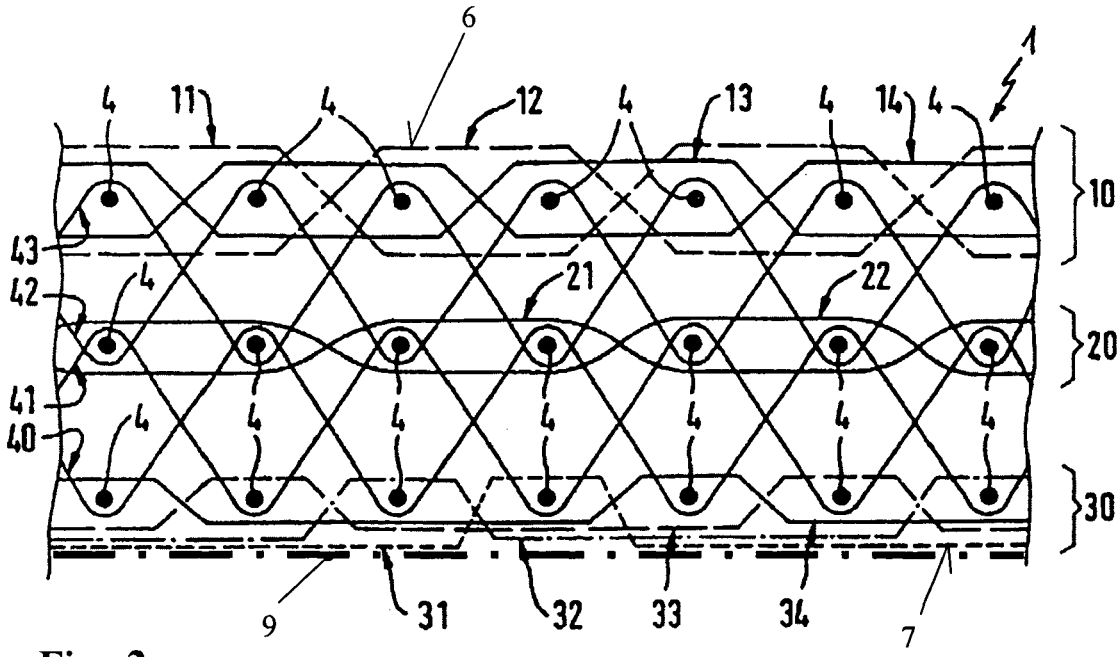
FIG. 2 is a longitudinal section of the fiber course through a fabric belt.
Figure 3:
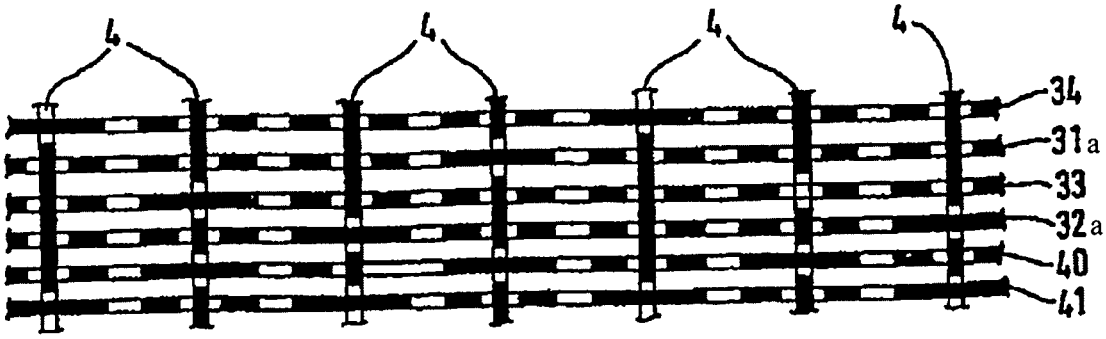
FIG. 3 is a plan view of the fiber course in the driven side of the fabric belt of FIG. 2.
Figure 4:
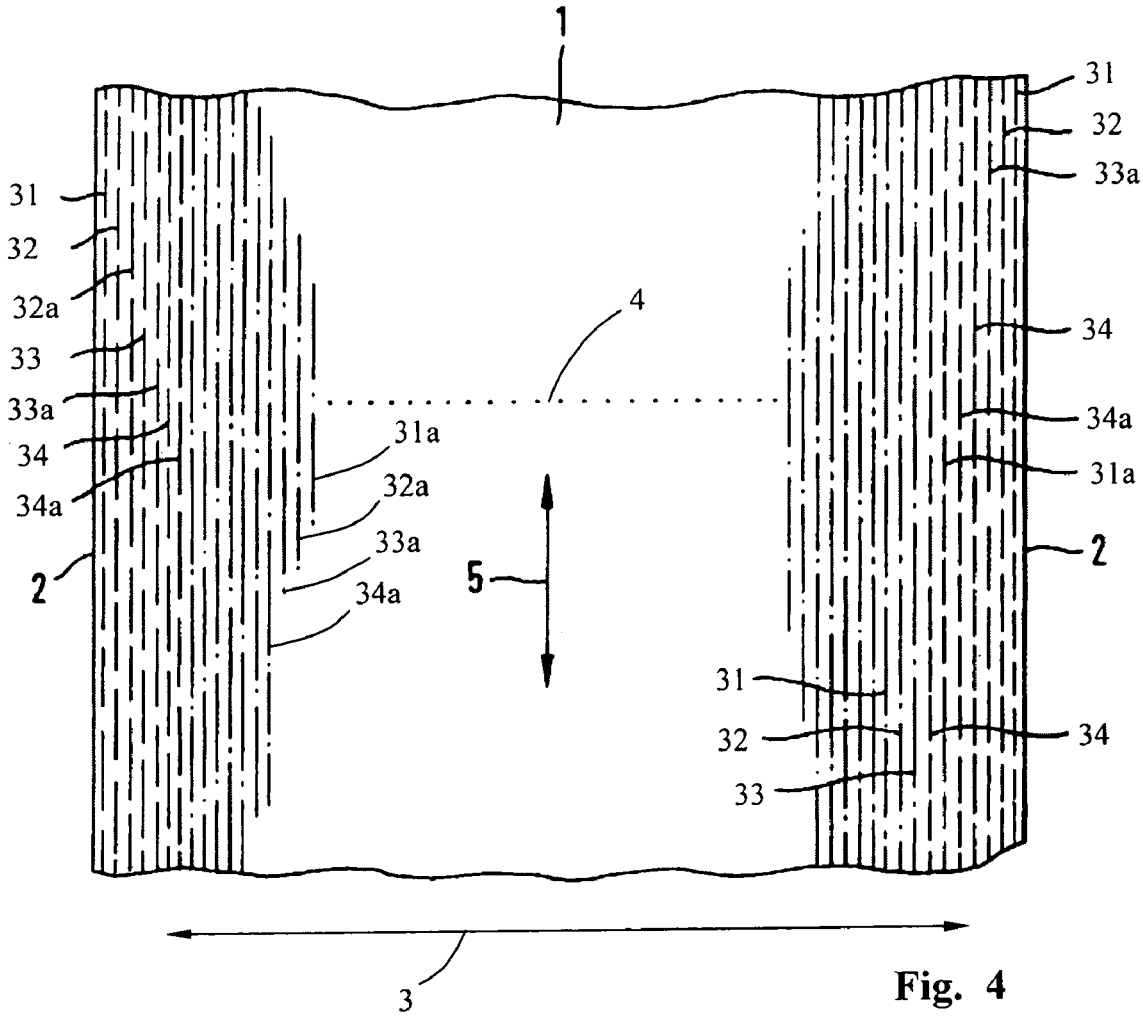
FIG. 4 is a schematic plan view of the fabric belt of FIG. 2.

A belt 1, which can be used in the corrugator machine of FIG. 1, is shown as an embodiment in FIGS. 2 to 4. The belt 1 is made of a fabric of plastic fibers (FIG. 2) and, in the embodiment shown, comprises an upper fabric layer 10, a middle fabric layer 20 and a lower fabric layer 30. The side of the upper fabric layer 10, which faces away from the middle fabric layer 20, defines the paper side of the fabric belt 1 facing toward the corrugator board. The side of the lower fabric layer 30, which faces away from the middle fabric layer 20, defines the driven side 7 of the fabric belt 1 facing toward the drive drum 62.

The weft fibers 4 run transversely to the longitudinal direction 5 (FIGS. 3 and 4) in the fabric layers (10, 20, 30). Four mutually offset running warp fibers (11, 12, 13, 14) (FIG. 2) are provided in the upper fabric layer 10. These warp fibers run inwardly to the middle fabric layer 20 as well as outwardly to the paper side 6 over respective ones of at least two weft fibers 4. The lower fabric layer 30 comprises four warp fibers (31, 32, 33, 34), which run offset one with respect to the other. These warp fibers run inwardly to the middle fabric layer 20 over only one weft fiber 4 and outwardly toward the driven side 7 over at least three weft fibers 4 (FIGS. 2 and 3).

The middle fabric layer 20 includes two warp fibers 21 and 22, which run offset with respect to each other, and which run over two weft fibers 4, respectively.

The three fabric layers (10, 20, 30) are interwoven with each other by binding fibers (40, 41, 42, 43). The binding fibers are subdivided into two fiber groups. The binding fibers (42, 43) which define one fiber group, run offset with respect to each other and bind the upper fabric layer 10 to the middle fabric layer 20. The binding fibers 42 and 43 are each alternately guided over a weft fiber 4 in the upper fabric layer 10 and a weft fiber 4 in the middle fabric layer 20. In a corresponding manner, the fiber group, defined by the binding fibers 40 and 41, binds the lower fabric layer 30 to the middle fabric layer 20.

In lieu of the three-layer fabric belt 1 shown in the embodiment, a two-layer or one-layer fabric belt can be used as the upper belt 1 or the lower belt 1*a* in the corrugator machine 60 of FIG. 1.

In a simple embodiment of the invention, a coating 9 is provided for reducing the coefficient of friction on the driven side 7. This coating 9 has a lower coefficient of friction than the fabric material defining the driven side 7. The coating can be a slide-friendly plastic, especially a fully fluorinated polymer, for example, a polytetrafluoroethylene, which is offered in the marketplace under the commercial name of TEFLON. The material is especially a material which lubricates during operation so that the coating becomes distributed over the entire surface on the driven side during operation even when the coating 9 is applied only partially to the driven side 7. Accordingly, the coating 9 can be applied as a sprayed-on or glued-on lattice network or the like onto the driven side 7 in order to lubricate during operation and cover the entire driven side 7.

Figure 5:
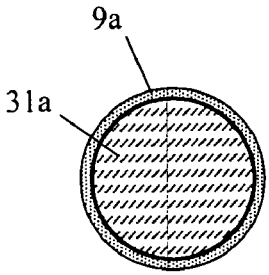
FIG. 5 is a section view through a fabric fiber of the belt having an outer coating of a friction coefficient reducing material; and, FIG. 6 is a schematic section view through a twisted fiber unit of individual fibers of polyester and polytetrafluoroethylene.
Figure 6:
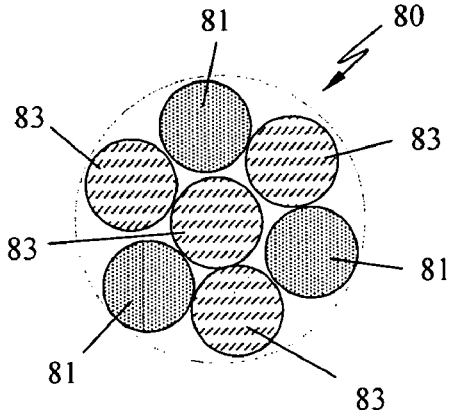

In a further embodiment of the invention, the friction coefficient reducing material is applied at least to some of the fibers of the driven side 7, preferably, to the warp fibers (31*a*, 32*a*) (FIG. 3) or (31*a*, 32*a*, 33*a*, 34*a*) (FIG. 4). A section through such a warp fiber 31*a* is shown in FIG. 5. The coating 9*a* of the friction coefficient reducing material can encase the warp fiber 31*a* partially, preferably, completely.

So far as the friction coefficient reducing lubricating material is processed to a fiber, it is practical that some of the warp fibers (31*a*, 32*a*, 33*a*, 34*a*) are completely manufactured of this material and are woven into the driven side 7.

In a further embodiment of the invention, twisted fibers 80 are provided in the form of warp fibers (31*a*, 32*a*, 33*a*, 34*a*) on the driven side 7. Twisted fibers 80 of this kind are comprised of individual strands 83 of an unchanged fiber material such as polyester or the like and another portion of the strands is comprised of the material with a lower coefficient of friction such as polytetrafluoroethylene. Twisted fibers 80 of this kind are used as warp fibers on the driven side 7. The strands 81, which are comprised of the friction coefficient reducing material, ensure in such a manner a good lubrication of the driven side 7 with the friction coefficient reducing material over a long service life. The sliding resistance between the press shoe 75 and the driven side 7 of the fabric belt 1 is low over a long service life.

As shown in FIG. 4, essentially all warp fibers (31*a*, 32*a*, 33*a*, 34*a*) have friction coefficient reducing material in a middle region 3 of the fabric belt 1 lying between the longitudinal edges 2. This friction coefficient reducing material has a lower coefficient of friction than the material from which the other fabric fibers are made, for example, the weft fibers 4.

It is understood that the foregoing description is that of the preferred embodiments of the invention and that various changes and modifications may be made thereto without departing from the spirit and scope of the invention as defined in the appended claims.

What is claimed is:

1. A belt for a corrugator machine for manufacturing corrugated board having a middle layer made of corrugated material and a covering outer layer made of smooth material which are bonded together under pressure with adhesive, the belt defining a longitudinal direction and having a driven side, and said corrugator machine defining a transport direction and including a pressure element and a countersupport conjointly defining a pressure zone of said corrugator machine, said corrugated board and said belt lying thereon in said longitudinal direction and said belt with said corrugated board passing between said pressure element and said countersupport in said transport direction and said corrugator machine further including a drive unit arranged on said driven side of said belt for developing tension forces acting in said longitudinal direction, the belt comprising:

a fabric of warp fibers and weft fibers;

said fabric defining a paper side of said belt facing away from said driven side and facing toward said corrugated board to be manufactured;

said fabric defining said driven side of said belt with said driven side facing away from said paper side and having a coefficient of friction;

a material disposed on said driven side for reducing said coefficient of friction of said driven side; and, said material being applied to said driven side of said belt as a coating and being a lubricating material when said belt is in operation.

2. The belt of claim 1, wherein said material is applied to the entire area of said driven side.

3. The belt of claim 1, wherein said material is applied to at least some of said fibers of said driven side.

4. The belt of claim 1, wherein said material is applied to the warp fibers of said driven side.

5. The belt of claim 1, wherein at least some of said fibers of said driven side are made of said material.

6. The belt of claim 1, wherein at least some of the warp fibers of said driven side are made of said material.

7. The belt of claim 1, wherein at least some of said fibers of said driven side are twisted fibers comprising a plurality of strands; and, a first portion of said strands are unchanged strands and a second portion of said strands are made of a material having a lower coefficient of friction than said first portion.

8. The belt of claim 7, wherein said first portion of strands are made of polyester; and, said second portion of said strands are made of polytetrafluoroethylene.

9. The belt of claim 1, wherein the warp fibers of said driven side are twisted fibers comprising a plurality of strands; and, a first portion of said strands are unchanged fibers and a second portion of said strands are made of a material having a lower coefficient of friction than said first portion.

10. The belt of claim 9, wherein said second portion of said strands are made of polytetrafluoroethylene.

11. The belt of claim 3, wherein said belt has longitudinal edges; said driven side has a region lying between said longitudinal edges; and, essentially all warp fibers of said region are provided with said material for reducing said coefficient of friction.

12. The belt of claim 3, wherein said material has a lower coefficient of friction than the material of the remainder of said fibers.

13. The belt of claim 1, wherein said material is a slide-friendly plastic.

14. The belt of claim 13, wherein said slide-friendly plastic is a fully fluorinated polymer.

15. The belt of claim 13, wherein said material is polytetrafluoroethylene.

16. A belt for a corrugator machine for manufacturing corrugated board having a middle layer made of corrugated material and a covering outer layer made of smooth material which are bonded together under pressure with adhesive, the belt defining a longitudinal direction and having a driven side, and said corrugator machine defining a transport direction and including a pressure element and a countersupport conjointly defining a pressure zone of said corrugator machine, said corrugated board and said belt lying thereon in said longitudinal direction and said belt with said corrugated board passing between said pressure element and said countersupport in said transport direction and said corrugator machine further including a drive unit arranged on said driven side of said belt for developing tension forces acting in said longitudinal direction, the belt comprising;

a fabric including at least warp fibers and weft fibers and being made of a first material having a first coefficient of friction;

said fabric defining a paper side of said belt facing away from said driven side and facing toward said corrugated board to be manufactured;

said fabric defining said driven side of said belt with said driven side facing away from said paper side;

a second material arranged on said driven side for reducing said first coefficient of friction of said driven side;

said second material having a second coefficient of friction lower than said first coefficient of friction; and, said second material being applied to said driven side of said belt as a coating and being a lubricating material when said belt is in operation.

17. A belt for a corrugator machine for manufacturing corrugated board having a middle layer made of corrugated material and a covering outer layer made of smooth material which are bonded together under pressure with adhesive, the belt defining a longitudinal direction and having a driven side, and said corrugator machine defining a transport direction and including a pressure element and a countersupport conjointly defining a pressure zone of said corrugator machine, said corrugated board and said belt lying thereon in said longitudinal direction and said belt with said corrugated board passing between said pressure element and said countersupport in said transport direction and said corrugator machine further including a drive unit arranged on said driven side of said belt for developing tension forces acting in said longitudinal direction, the belt comprising:

a fabric of warp fibers and weft fibers;

said fabric defining a paper side of said belt facing away from said driven side and facing toward said corrugated board to be manufactured;

said fabric defining said driven side of said belt with said driven side facing away from said paper side and having a coefficient of friction;

a material disposed on said driven side for reducing said coefficient of friction of said driven side; and, at least some of said fibers of said driven side are twisted fibers comprising a plurality of strands; and, a first portion of said strands are unchanged strands and a second portion of said strands are made of a material having a lower coefficient of friction than said first portion.

18. The belt of claim 17, wherein said first portion of strands are made of polyester; and, said second portion of said strands are made of polytetrafluoroethylene.

19. A belt for a corrugator machine for manufacturing corrugated board having a middle layer made of corrugated material and a covering outer layer made of smooth material which are bonded together under pressure with adhesive, the belt defining a longitudinal direction and having a driven side, and said corrugator machine defining a transport direction and including a pressure element and a countersupport conjointly defining a pressure zone of said corrugator machine, said corrugated board and said belt lying thereon in said longitudinal direction and said belt with said corrugated board passing between said pressure element and said countersupport in said transport direction and said corrugator machine further including a drive unit arranged on said driven side of said belt for developing tension forces acting in said longitudinal direction, the belt comprising:

a fabric of warp fibers and weft fibers;

said fabric defining a paper side of said belt facing away from said driven side and facing toward said corrugated board to be manufactured;

said fabric defining said driven side of said belt with said driven side facing away from said paper side and having a coefficient of friction;

a material disposed on said driven side for reducing said coefficient of friction of said driven side;

the warp fibers of said driven side being twisted fibers comprising a plurality of strands; and, a first portion of said strands being unchanged fibers and a second portion of said strands being made of a material having a lower coefficient of friction than said first portion.

20. The belt of claim 19, wherein said second portion of said strands are made of polytetrafluoroethylene.

* * * * *